United States Patent [19]

Waryasz

[11] Patent Number: 4,641,608

[45] Date of Patent: Feb. 10, 1987

[54] STEAM GENERATOR WITH EXPANSION JOINT

[75] Inventor: Richard E. Waryasz, Longmeadow, Mass.

[73] Assignee: Combustion Engineering, Inc., Windsor, Conn.

[21] Appl. No.: 697,812

[22] Filed: Feb. 4, 1985

[51] Int. Cl.[4] ..... F22B 37/24

[52] U.S. Cl. ..... 122/510; 122/4 D; 165/81

[58] Field of Search ..... 110/245, 263; 165/81; 122/4 D, 231, 235 D, 360, 365, 510, 511, DIG. 11, 209 R, 224

[56] References Cited

U.S. PATENT DOCUMENTS

| | | | |
|---|---|---|---|
| 3,208,436 | 9/1965 | Godshalk | 122/510 |
| 3,839,993 | 10/1974 | Peterson | 122/231 X |
| 4,286,549 | 9/1981 | Eisinger | 122/510 |
| 4,290,388 | 9/1981 | Ruhe et al. | 122/510 X |
| 4,440,113 | 4/1984 | Forster et al. | 122/209 R X |
| 4,510,892 | 4/1985 | Wincze et al. | 122/4 D X |

OTHER PUBLICATIONS

"The C-E Power Systems Final Design Development for the TVA 200-MW Atmospheric FBC Demonstration Plant," Combustion Engineering, 10-1982, pp. 1-5.

*Primary Examiner*—Albert J. Makay
*Assistant Examiner*—Steven E. Warner
*Attorney, Agent, or Firm*—Edward L. Kochey, Jr.

[57] ABSTRACT

A fluidized bed steam generator with a bottom supported furnace wall structure (14) and a top supported gas pass structure (22). A gas tight expansion joint (26) joins the two structures. Convection heating surface (74,76) is supported (80) within the gas pass below the expansion joint, whereby an expansion joint of relatively low temperature design may be used.

4 Claims, 3 Drawing Figures

STEAM GENERATOR WITH EXPANSION JOINT

BACKGROUND OF THE INVENTION

This invention relates to steam generators and in particular to large units with combustion being carried out in a fluidized bed.

Small steam generators are bottom supported. This is the simplest construction with the entire unit being posted from the bottom support. Such a design is impractical however, for a large steam generator because of the great height, high loads and significant expansion. These large steam generators are therefore top supported from building steel with the unit expanding downwardly.

When a fluidized bed is used for combustion in a large steam generator, it imposes extremely high loads on the unit. This makes top support of the entire unit difficult. It therefore, is desirable to combine both bottom and top support by including an expansion joint within the unit. This is illustrated in a technical paper by Joseph R. Comparato entitled "C-E Power System Filled Design Development for the TVA 200-MW Atmospheric Fluidized Bed Combustion Demonstration Plant" presented at the seventh international conference on fluidized bed combustion, Oct. 25–27, 1982. U.S. Pat. No. 3,208,436 issued to R. L. Godchaulk illustrates a large steam generator with expansion joints in the water walls.

These prior art joints must be designed for high temperature which leads to questionable reliability and susceptibility to plugging from solids in the combustion products.

SUMMARY OF THE INVENTION

The steam generator includes a fluidized bed with the bottom supported perforated plate for supporting the fuel. The bottom supported furnace wall structure encloses the perforated plate and extends upwardly to conduct the combustion gases. It has a reducing plane area with elevation.

A top supported gas wall structure is located above the furnace wall structure for receiving the combustion gas products. The gas tight expansion joint joins these two structures. Convection heating surface is located in the gas pass of the bottom supported furnace wall structure below the elevation of the expansion joint whereby the gas temperature is reduced before it reaches the elevation of the expansion joint, thereby making it possible to use a low temperature expansion joint.

DESCRIPTION OF THE PREFERRED EMBODIMENT

Figure 1:
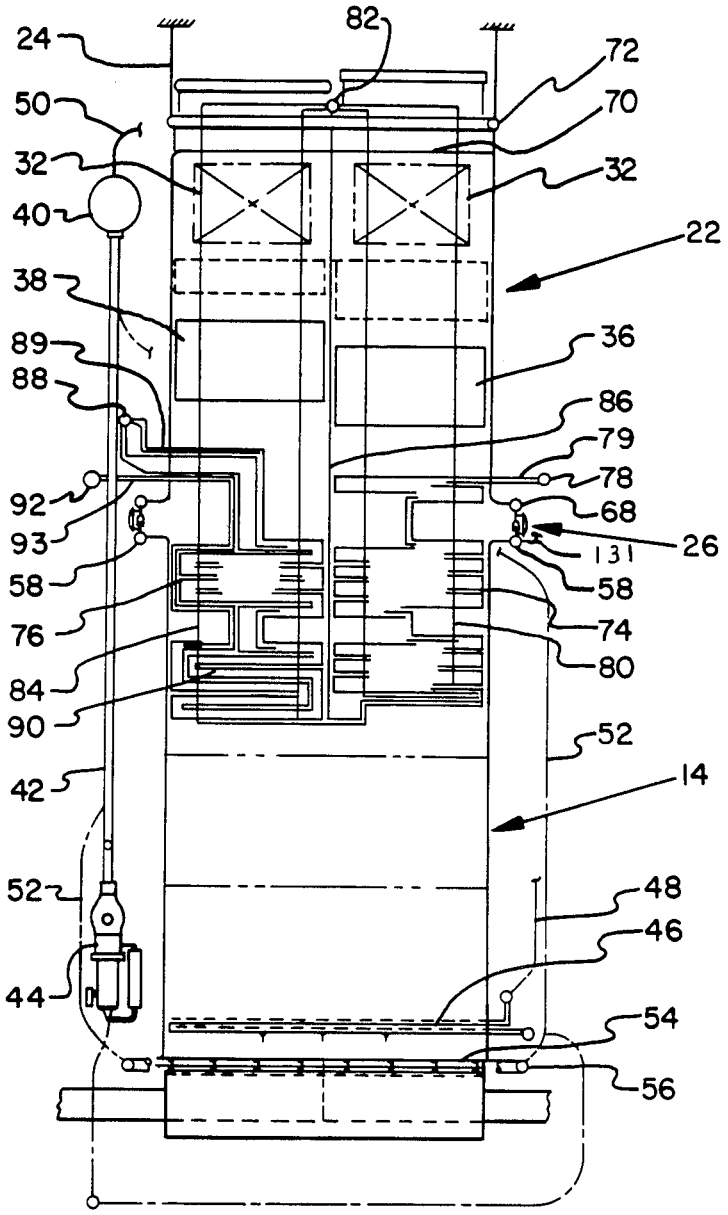
FIG. 1 is a sectional front elevation of the steam generator.
Figure 2:
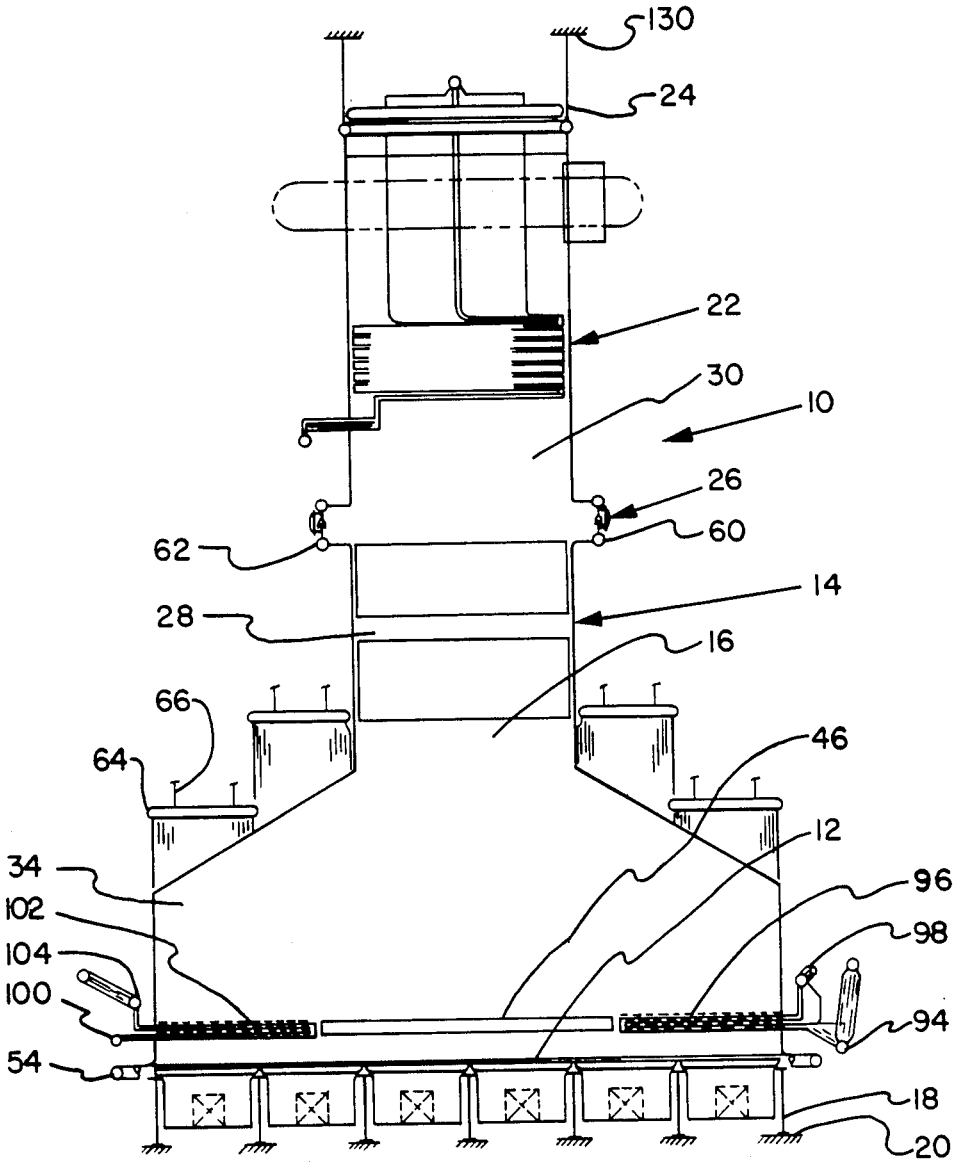
FIG. 2 is a sectional side elevation of the steam generator.

The steam generator 10 includes a perforated plate 12 for the support of inert material and the coal to be burned. Air supply from beneath the grate fluidizes the bed for combustion of the coal thereby producing combustion products which flow upwardly. A furnace wall structure 14 is comprised of a plurality of vertical tubes welded together in gas tight relationship. This structure encloses a first plan area of the perforated plate 12 with the structure rising vertically and then tapering inwardly from the sides to enclose a reduced plan area at the combustion gas outlet 16. Both the perforated plate 12 and furnace wall structure 14 are bottom supported from beams 18 which are supported on the ground 20.

A gas pass wall structure 22 which is gas tight, is supported by hanger rods 24 from an upper elevation, and supported directly over the furnace wall structure 14 so that it may receive combustion gases therefrom. A gas tight expansion joint 26 joins the furnace wall structure 14 and the gas pass wall structure 22. Fuel is burned within the fluidized bed above the perforated plate 12 with the combustion gas products passing upwardly to outlet 16 and flue 28, continuing through gas pass 30 to side gas duct outlets 32. The gas temperature immediately above the fluidized bed is approximately 1600° F. and as it rises through the free board volume 34 it increases to about 1750° F. as the carbon is burned out, thereafter decreasing to about 1600° F. at the outlet 16 because of radiation to the bounding water walls.

Feed water supply to the steam generator passes through tubular economizer surface 36 and 38 then passing to the steam drum 40. The flow of water from the steam drum 40 passes through downcomer 42 through circulating pump 44 to and through heating surface 46 located in the center portion of the fluidized bed. The steam water mixture generated there passes through a riser tube 48 returning to the upper portion of steam drum 40 where the steam and water is separated. The steam passes outwardly through steam relief tubes 50 with the remaining water recirculating.

In parallel with the above described pumped recirculation circuit, water also flows through downcomers 52 to lower front and rear wall headers 54 and sidewall headers 56. These headers supply water to the tubes forming the furnace wall structure 14 with the water passing upwardly to the sidewall outlet headers 58, the front and rear wall outlet headers 60 and 62 as well as extension sidewall headers 64.

Headers 58, 60 and 62 form a ring header. The steam and water mixture from this ring header passes through riser tubes 131 and the steam and water mixture from the sidewall headers 64 passes through riser tubes 66 returning to the steam drum 40.

Steam from the steam drum 40 passes through connecting tubes 50 to ring header 68 at the inlet of the gas pass structure 22. This structure is comprised of fin welded tubes. There is a lower ring header 68, and an upper U-shaped header 72. The ring header 68 is partitioned into inlet and outlet sections. The partitions are located at the corners near the right side, which is adjacent to the superheater gas pass. The inlet portion is on the front wall, the rear wall and the sidewall of the reheater gas pass. The outlet portion is on the sidewall of the superheater gas pass. The U-shaped header is a junction header extending along the front wall, the rear wall, and the sidewall on the superheater gas pass side. Steam flow from the inlet flows in parallel up the rear wall, front wall, and the sidewall on the reheater gas pass side plus across the roof.

The U-shaped header receives flow along its entire length, and discharges it through to the sidewall tubes along the superheater gas pass. This flow passes to the outlet portion of the ring header 68.

Steam flows from the outlet portion of ring header 68 and passes through connecting tubes 132 to the inlet header 78 of superheater 74.

Superheat convection surface 74 and reheat steam convection surface 76 are both located within the furnace wall structure below the elevation of the expansion joint 26. The flow passes down sinuously through the tubes of superheater 74 to the lower portion thereof where a first portion of the tubes, comprising superheater supports 80, rise upwardly for supporting the superheat surface, passing through roof 70 to outlet header 82. Another portion of the superheat tubes form reheat surface support tubes 84 which also pass upwardly through roof 70 to the outlet header 82. The third portion of the superheat tubes form a gas restraining wall 86 which also passes upwardly through the roof 70 to the outlet header 82.

The superheated steam passes from the low temperature superheat outlet header 94 to the intermediate superheater inlet header 94, through the intermediate superheater 96 and to the intermediate superheater outlet header 98. From here it flows to the finishing superheater inlet header 100, through the finishing superheater outlet header 104, and to a turbine, not shown.

Reheat steam from the turbine passes through reheat inlet header 88 and through reheat surface 90 exiting to reheat outlet header 92, from which the steam flows to a low pressure turbine not shown.

Figure 3:
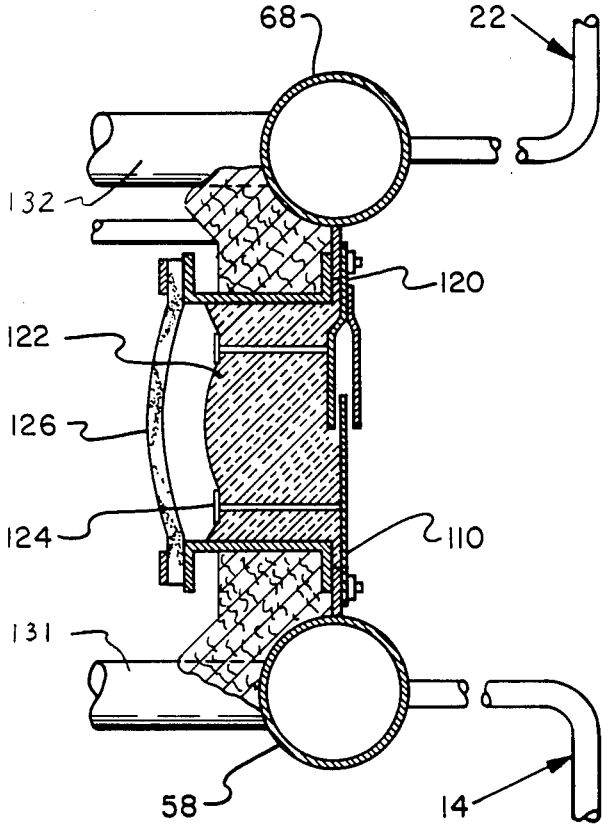
FIG. 3 is a detail of the low temperature expansion joint.

The gas temperature entering flue 16 is about 1600° F. The gas must thereafter pass over the superheat surface 74 or reheat surface 76 before reaching the elevation of the expansion joint 26. In passing over this surface the gas is cooled to a temperature of 980° F. This makes it possible to supply an expansion joint at that location which does not include all of the complications of the prior art expansion joints. Such a simplified expansion joint is illustrated in FIG. 3.

During operation of the steam generator from the cold condition, the furnace wall outlet ring header, comprised of headers 60, 62 and 68, will move upward. The lower ring header 68 of the gas pass structure moves downward. Flanges welded to each of the headers secure bolted attachments 110 and 120 respectively for the purpose of providing a shield and attachment plate for a ceramic insulation pillow 122. This pillow is retained to the plate with retaining clips 124. A fabric expansion joint 126 is formed in a layered construction. Starting with the outside is a flouroelastomer reinforced with 2 plys of alloy wire and 2 plys of glass. This layer is lined on the inside with FEP (flourinated ethylene propolene). This is followed by a glass fabric retainer, a thermal barrier, a reinforced TFE (Tetraflourethylene) gas barrier and another thermal barrier. This composite construction is designed to allow for the thermal gradient imposed on it while insuring a gas tight relationship to the structure of the headers 58 and 68. This provides a gas tight flexible connection suitable for operation at a gas temperature up to approximately 1200° F., which is amply conservative for the existing gas temperature of 980° F.

The furnace wall structure 14 being bottom supported from ground 20 expands as it reaches operating temperature moving the structure and the outlet headers 58, 60 and 62 upwardly in the amount depending on the temperature of the furnace wall structure 14. The gas pass wall structure 22 being supported from building steel 130 at an upper elevation expands as it reaches temperature with the inlet header 68 moving downwardly an amount which is a function of the actual temperature of the gas pass wall structure 22.

The inlet terminal 79 of the superheater 74 as well as all the outlet terminals pass through the walls of the gas pass wall structure 22 rather than the furnace wall structure 14, thereby minimizing the expansion differences which must be considered. Also, the inlet terminals 89 and the outlet terminals 93 of the reheater 76 pass through the walls of the gas pass wall structure 22 for the same reason.

I claim:

1. A fluidized bed steam generator for generating high temperature steam comprising:

a bottom supported perforated plate for supporting fluidizable fuel which may be burned forming combustion gas products;

a bottom supported furnace wall structure comprised of gas tight enclosing sidewalls extending upwardly from said perforated plate for the conduction of combustion gas products therefrom;

said furnace wall structure enclosing a first plan area at the perforated plate elevation, and a reduced plan area at an upper elevation;

a top supported gas pass wall structure located above said furnace structure for receiving combustion gas products therefrom;

a gas tight expansion joint joining the periphery of the lower end of said gas pass wall structure to the periphery of said furnace wall structure for permitting relative vertical movement of the two structures while maintaining a gas tight seal;

convection heating surface supported within said furnace wall structure at an upper elevation below said expansion joint, whereby the combustion gas products must pass over said convection surface before reaching the elevation of said expansion joint.

2. A steam generator as in claim 1: said convection surface comprising steam heating surface, the inlet and outlet terminals of said steam heating surface passing through the walls of said gas pass wall structure.

3. A steam generator as in claim 2: the gas tight portion of said expansion joint comprising a fabric expansion joint.

4. A fluidized bed steam generator for generating high temperature steam comprising:

a bottom supported perforated plate for supporting fluidizable fuel which may be burned forming combustion gas products;

a bottom supported furnace wall structure comprised of gas tight enclosing sidwalls extending upwardly from said perforated plate for the conduction of combustion gas products therefrom;

said furnace wall structure enclosing a first plan area at the perforated plate elevation, and a reduced plan area at an upper elevation;

a top supported gas pass wall structure located above said furnace structure for receiving combustion gas products therefrom;

a gas tight expansion joint joining the periphery of the lower end of said gas pass wall structure to the periphery of said furnace wall structure for permitting relative vertical movement of the two structures while maintaining a gas tight seal;

convection heating surface supported within said furnace wall structure at an upper elevation below said expansion joint, whereby the combustion gas products must pass over said convection surface before reaching the elevation of said expansion joint;

said convection surface comprising steam heating surface, the inlet and outlet terminals of said steam heating surface passing through the walls of said gas pass wall structure;

said gas pass wall structure also including a roof section located over the plan area of said gas pass wall structure; and outlet terminal tubes from said steam heating surface passing up through said roof and supporting said convection surface.

* * * * *